US005957825A

United States Patent [19]

Marchetti

[11] Patent Number: 5,957,825

[45] Date of Patent: Sep. 28, 1999

[54] PARALLELEPIPED CARTON FORMING MACHINE

[76] Inventor: Augusto Marchetti, Piazza Sicilia, 7-20146 Milan, Italy

[21] Appl. No.: 08/941,741

[22] Filed: Oct. 1, 1997

[30] Foreign Application Priority Data

Oct. 1, 1996 [IT] Italy ..... MI96A2007

[51] Int. Cl.[6] ..... B31B 1/80

[52] U.S. Cl. ..... 493/313; 493/309; 53/564; 53/381.1

[58] Field of Search ..... 493/309, 313; 53/382.1, 381.1, 564, 458, 491, 376.8, 376.4

[56] References Cited

U.S. PATENT DOCUMENTS

| | | | |
|---|---|---|---|
| Re. 27,631 | 5/1973 | Berney | 493/313 |
| 3,358,567 | 12/1967 | Tucker et al. | 53/564 |
| 3,537,361 | 11/1970 | Derderian et al. | 53/564 |
| 3,608,440 | 9/1971 | Reichert et al. | 493/313 |
| 3,739,696 | 6/1973 | Pearson . | |
| 4,275,543 | 6/1981 | Marchetti | 53/381.1 |
| 5,186,706 | 2/1993 | Hartness et al. | 493/309 |

FOREIGN PATENT DOCUMENTS 260749 3/1988 European Pat. Off. .

*Primary Examiner*—John Sipos
*Assistant Examiner*—Steven Jensen
*Attorney, Agent, or Firm*—Pillsbury Madison & Sutro

[57] ABSTRACT

A forming machine including a load and feed chute for a set of die-cut cardboard pieces folded in a flat shape and laid on the chute perpendicular to the chute plane and parallel one after another, from which die-cut cardboard pieces are picked one by one and partially opened by a set of depression suckers that moves in a horizontal direction between a first position near the exit of the chute and suitable for the engagement of the suckers with one of the two coplanar adjacent sides of the nearest die-cut cardboard and a second position suitable for moving the engaged side of the sucker away from the opposite side of the die-cut cardboard with simultaneous rotation of the other two sides of the die-cut cardboard. The machine provides for squaring elements to complete and to square the partially open die-cut cardboard. A first flap closing device forms the closing fold of first bottom flaps connected with the other two sides of the die-cut cardboard and a second flap closing device forms the closing fold of second bottom flaps connected with the side engaged by the suckers and the opposite side of the die-cut cardboard.

5 Claims, 9 Drawing Sheets

PARALLELEPIPED CARTON FORMING MACHINE

BACKGROUND OF THE INVENTION

The present invention consists of a forming machine for parallelepiped cartons.

This definition refers to an appliance that, starting from a die-cut cardboard folded into a flat shape, produces the opening of the die-cut cardboard into a parallelepiped shape at first and subsequently the rotation of the bottom foldable flaps providing the closure of the carton bottom.

Forming machines of various kinds, as for examples the ones described in U.S. Pat. No. 3,608,440, U.S. Pat. No. 3,739,696 and EP-A-0260794, are already known.

BRIEF SUMMARY OF THE INVENTION

An object of the present invention is to implement a new forming machine for parallelepiped cartons, differing from the known technology at both structural and operating level.

According to the invention such aim has been attained with a forming machine characterised in that it includes a load and feed chute for a set of die-cut cardboard pieces folded into a flat shape and laid on said chute perpendicular to the chute plane and parallel one after another, a set of depression suckers that move in horizontal direction between a first position near the exit of said chute and suitable for the engagement of the suckers with one of the two coplanar adjacent sides of the nearest die-cut cardboard and a second position suitable for moving the engaged side of the sucker away from the opposite side of the die-cut cardboard and with the simultaneous rotation of the other two sides of the die-cut cardboard for the subsequent arrangement of the die-cut cardboard in a state of partial opening with open flaps, squaring means for completing the opening and for squaring the partially open die-cut cardboard, first flap closing means for the closing fold of first bottom flaps connected with said other two sides of the die-cut cardboard and second flap closing means for the closing fold of second bottom flaps connected with the side engaged by the suckers and the opposite side of the die-cut cardboard.

Said squaring means will preferably provide also for the final expulsion of the formed cartons.

Again preferably, checking means will work in cooperation with the sucker means in order to hold said opposite side of the die-cut cardboard while the set of suckers is moved from the first to the second position described above, thus favouring the opening of the die-cut cardboard.

BRIEF DESCRIPTION OF THE SEVERAL VIEWS OF THE DRAWING

A preferred embodiment of the forming machine according to the invention will now be described by way of a non-restrictive example, with reference to the attached drawings, in which.

DETAILED DESCRIPTION OF THE INVENTION

Figure 1:
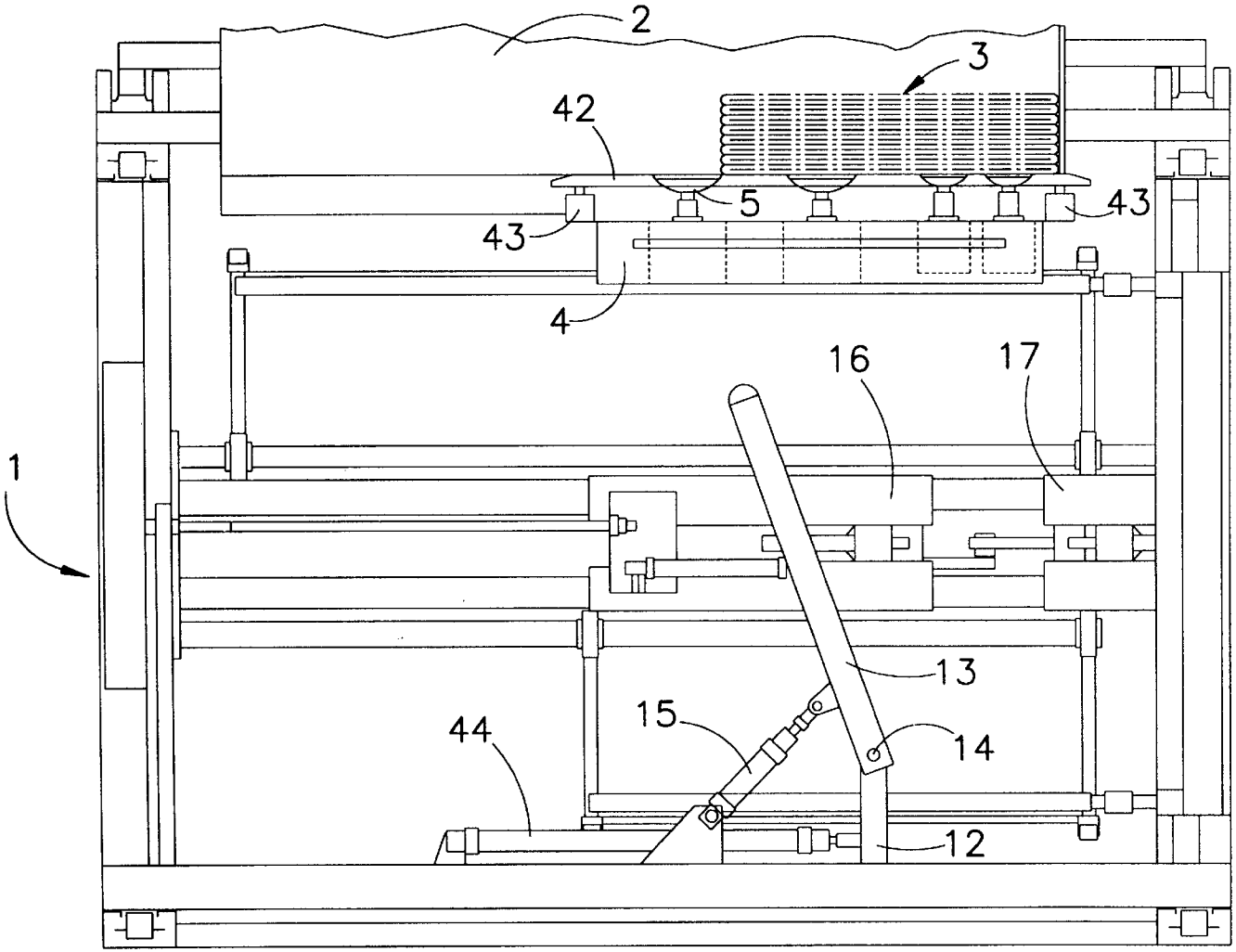
FIG. 1 shows a top plan view of the forming machine according to the invention at the beginning of its operating cycle.
Figure 3:
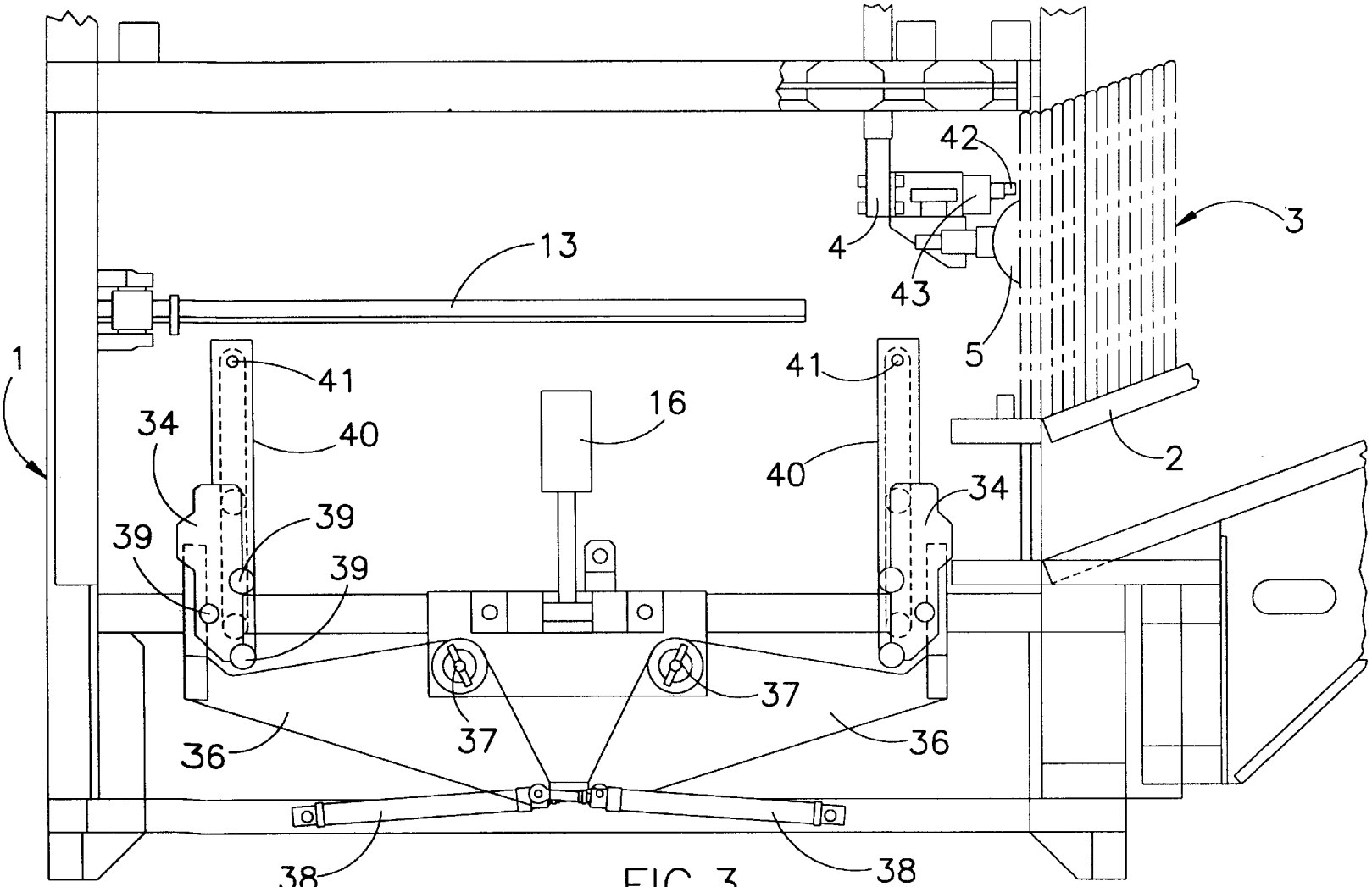
FIG. 3 shows a cross section of said forming machine at the beginning of its operating cycle.

The forming machine illustrated in the drawings includes a basic framework 1, from a side panel of which an inclined chute 2 extends upward, on which chute are available in vertical position, one after another, a number of die-cut cardboard pieces 3 folded into a flat shape (FIGS. 1 and 3).

Figure 4:
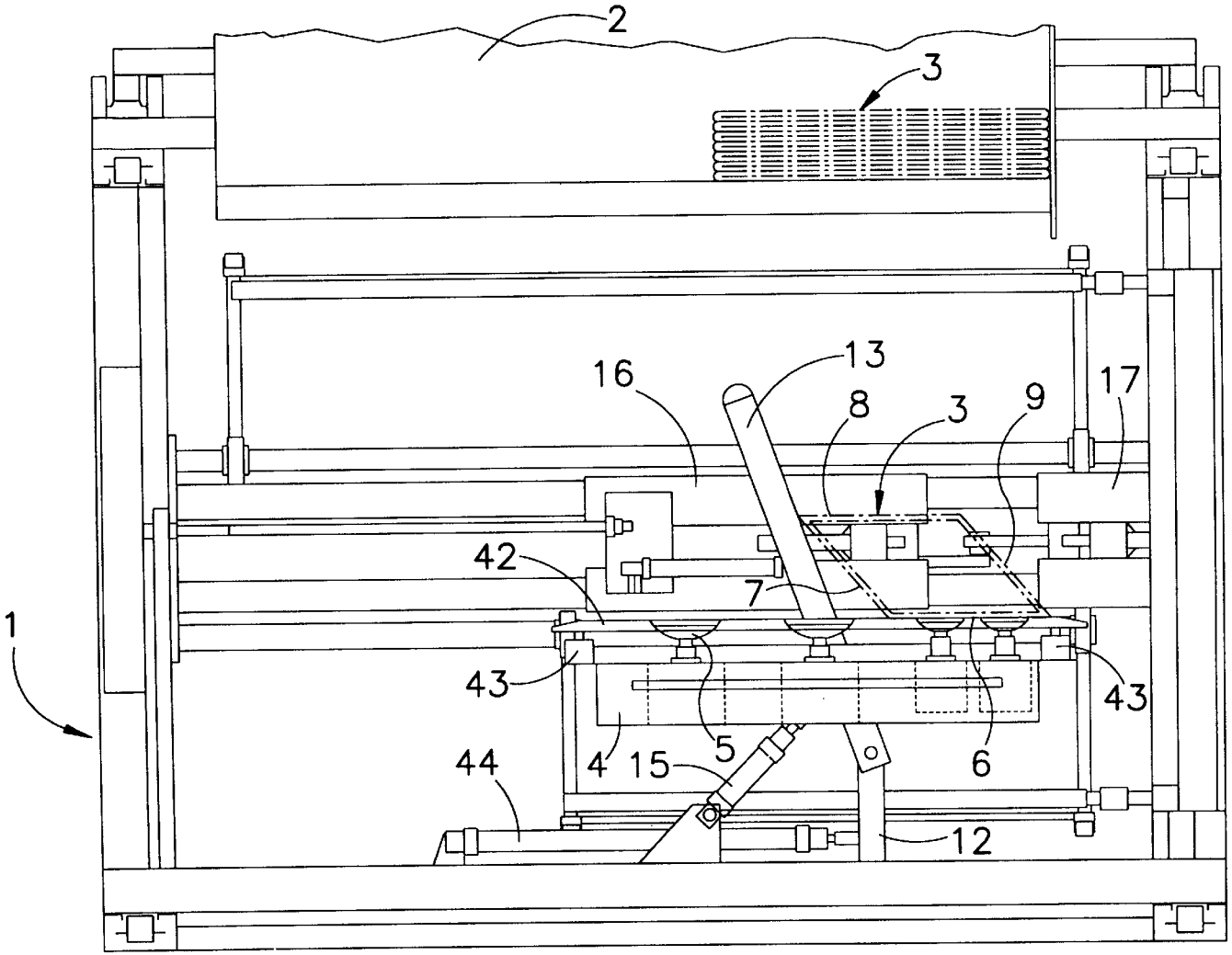
FIG. 4 shows a top plan view of the forming machine according to the invention during the die-cut cardboard pick up and partial opening phase.

The basic framework 1 slidably sustains a supporting frame 4 for a set of depression suckers 5, that can be moved horizontally, between the positions illustrated in FIGS. 1 and 4.

In the first one of the two positions the suckers 5, or at least a part of them subject to depression, engage the larger (6) of two coplanar adjacent sides 6 and 7 of the nearest die-cut cardboard 3. In the second position instead the suckers 5 move the same larger side 6 away from the opposite side 8 of the same die-cut cardboard, thus causing the simultaneous rotation of the two smaller sides 7 and 9 for the consequent disposition of the die-cut cardboard in a partially open state with open flaps, that is illustrated in FIG. 4. A contrasting brush 10 and a smaller brush 11 above it (FIG. 2) operate in cooperation with the suckers 5 in order to hold said opposite side of the die-cut cardboard while the suckers themselves are moved from the position in FIG. 1 to the position in FIG. 4, thus favouring the opening of the die-cut cardboard.

Figure 5:
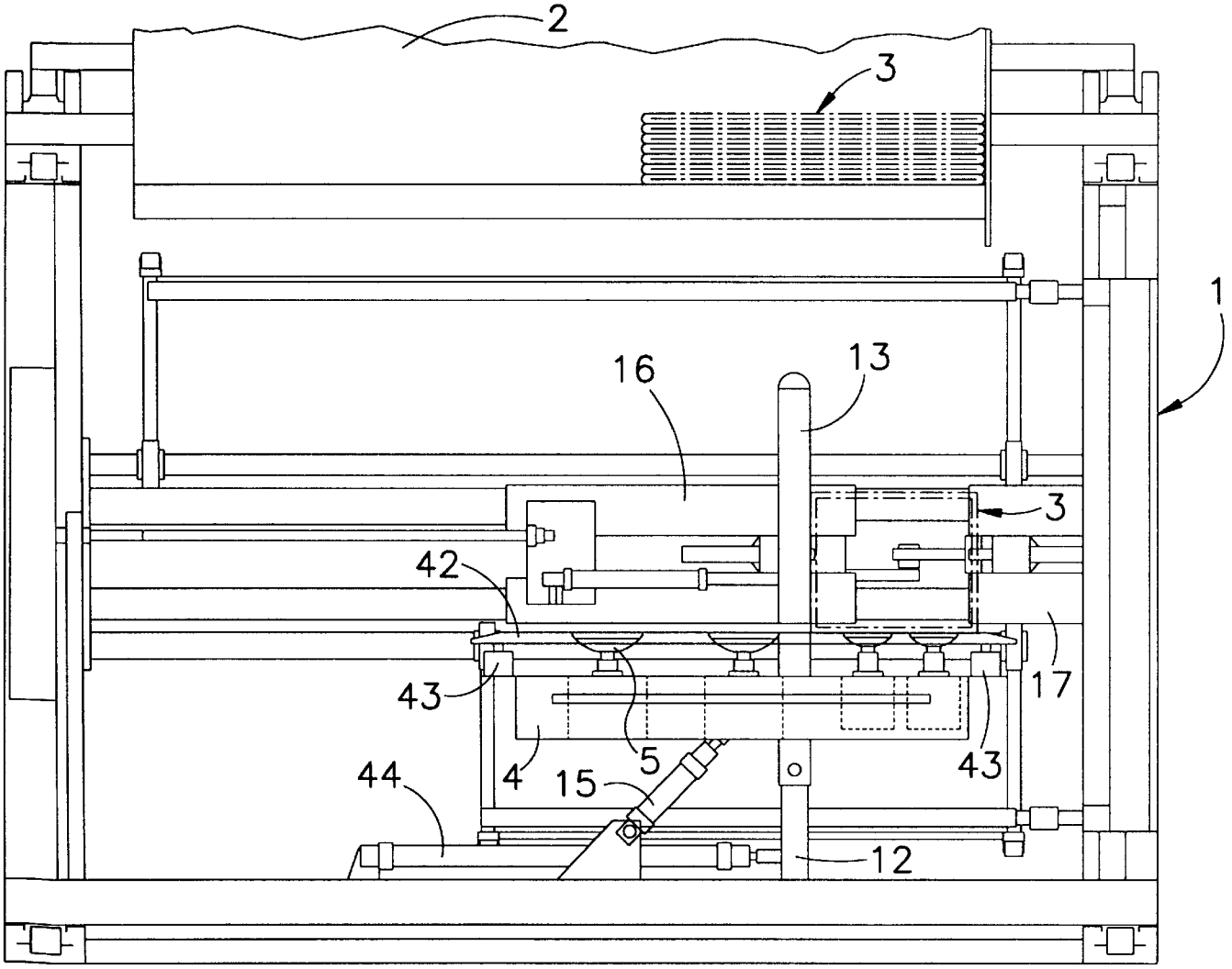
FIG. 5 shows a top plan view of said forming machine during the die-cut cardboard complete opening and squaring phase.

The basic framework 1 slidably holds however in a horizontal direction perpendicular to the sliding movement of the suckers frame 4, a support 12 for a horizontal arm 13 which is revolving in 14 with respect to the support itself, under the control of a pneumatic cylinder 15, between the inclined position of FIGS. 1 and 4 and the straight position of FIG. 5, parallel to the direction of movement of the suckers frame 4. In this last position the arm 13 squares out the half-open die-cut cardboard of FIG. 4, thus completing the opening. The sliding movement of the support 12 is controlled by a pneumatic cylinder 44.

Figure 6:
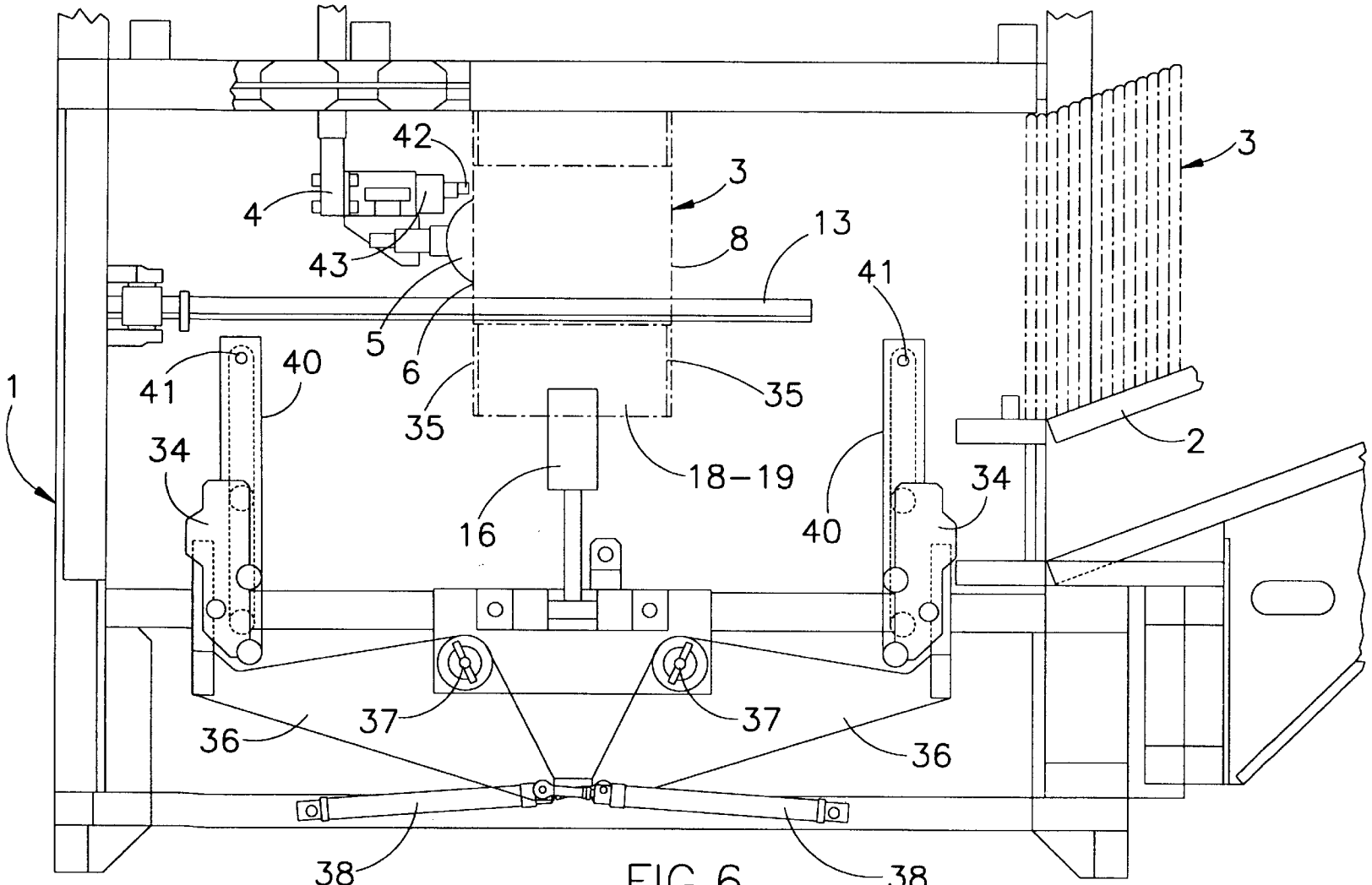
FIG. 6 shows a cross section of said forming machine during the same phase as described in FIG. 5.
Figure 7:
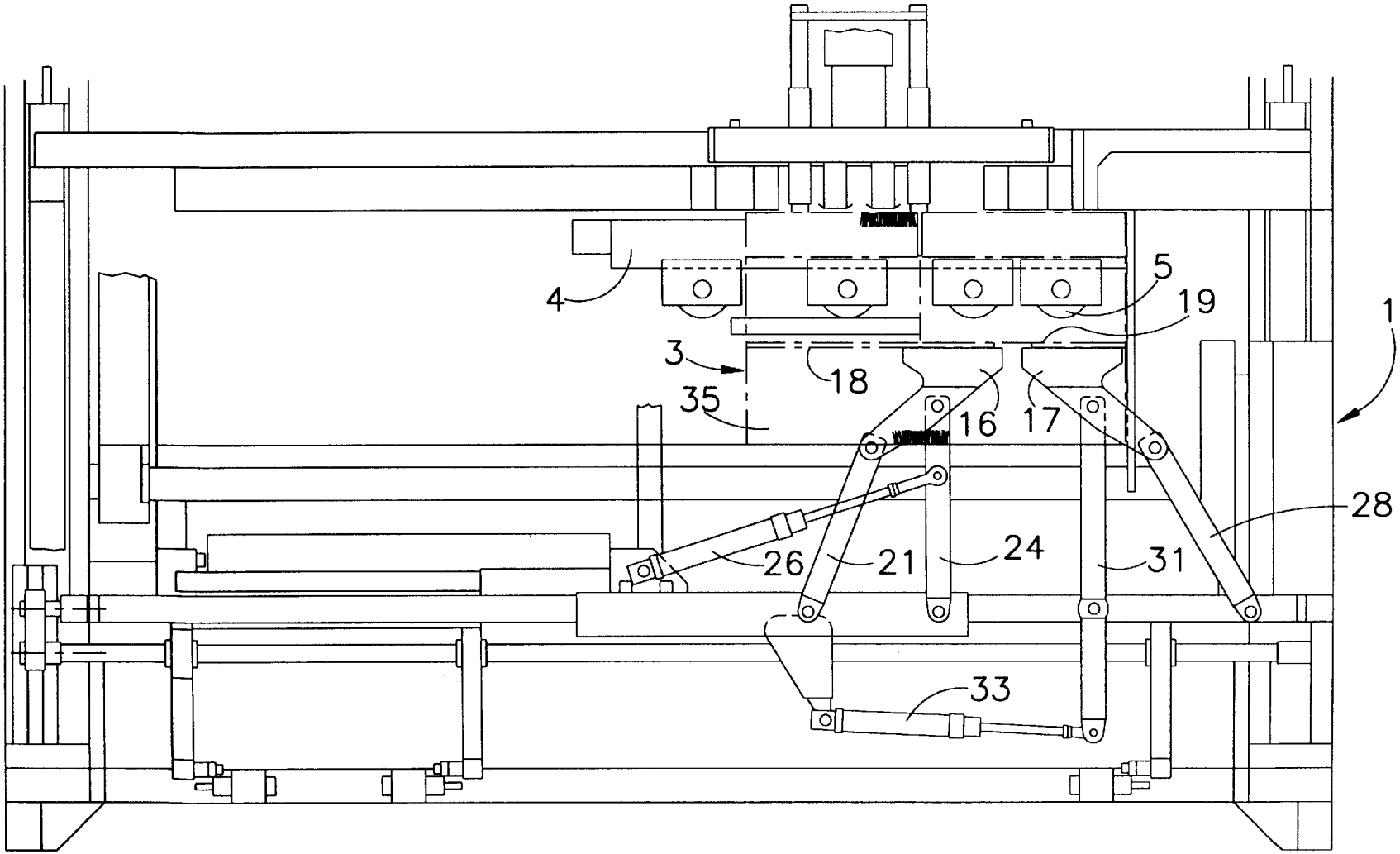
FIG. 7 shows a longitudinal section of said forming machine during the die-cut cardboard smaller bottom flaps closing phase.

The machine also provides for two levers 16 and 17 opposed to each other, responsible for the closing fold of the smaller bottom flaps 18 and 19 of the die-cut cardboard, after this has been opened and squared with its bottom flaps open as shown in FIGS. 5–7.

Figure 2:
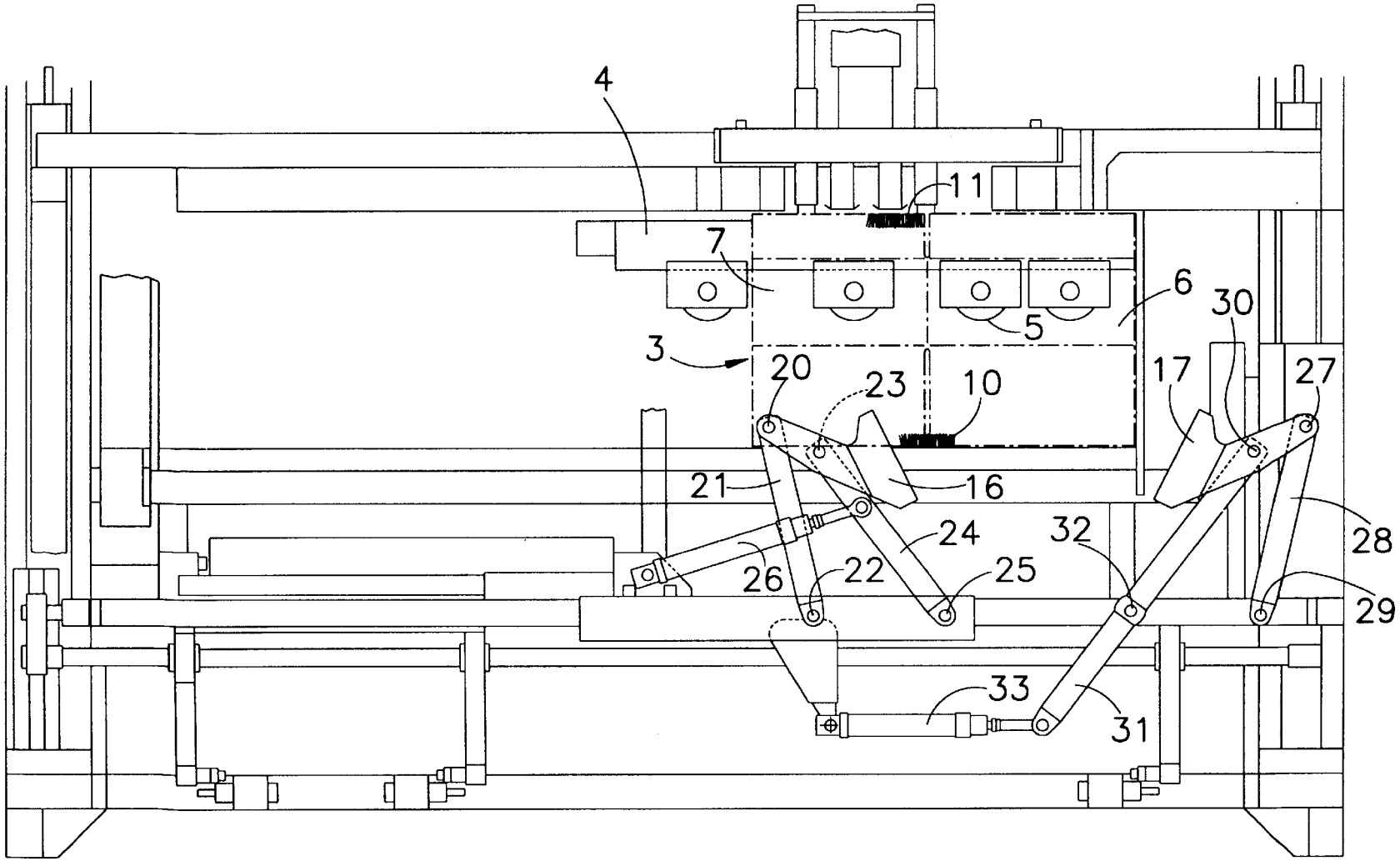
FIG. 2 shows a longitudinal section of said forming machine at the beginning of its operating cycle.

The folding lever 16, normally at the inclined position of FIG. 2, is hinged at 20 on a supporting arm 21 pivoted at 22 on the basic framework 1 and is further hinged at 23 on another rotating arm 24 pivoted at 25 on the basic framework 1 and set in motion by a pneumatic cylinder 26. This makes the folding lever 16 movable from its rest position illustrated in FIG. 2 to the work position illustrated in FIG. 7, in which it causes the smaller bottom flap 18 to turn over to the closed position.

The folding lever 17, which is also normally in the inclined position of FIG. 2, is hinged at 27 on a supporting arm 28 pivoted at 29 on the basic framework 1 and in addition it is hinged at 30 on another revolving arm 31 pivoted at 32 on the basic framework 1 and set in motion by a pneumatic cylinder 33. This makes the folding lever 17 movable from its rest position illustrated in FIG. 2 to the work position illustrated in FIG. 7, in which it causes the smaller bottom flap 19 to turn over to the closed position.

Finally the machine provides for two lateral blades 34 opposed to each other, responsible for the closing fold of the die-cut cardboard larger bottom flaps 35 subsequently to the closure of the smaller bottom flaps 18 and 19.

Figure 8:
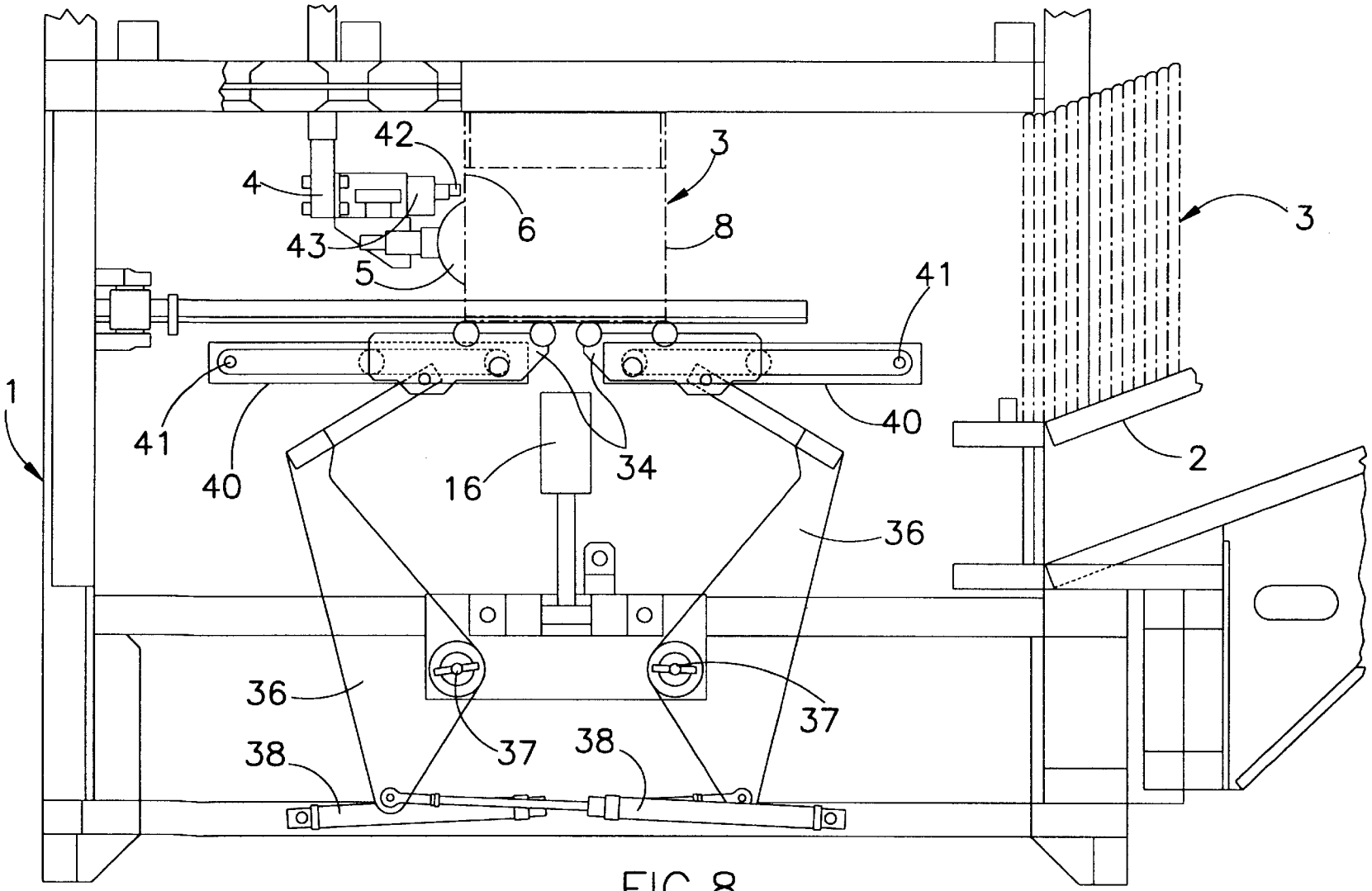
FIG. 8 shows a cross section of said forming machine during the die-cut cardboard larger bottom flaps closing phase.

Said lateral blades 34 are revolvingly held by pivoting arms 36, that revolve around their respective journals 37, under the control of pneumatic cylinders 38, between the rest position of FIGS. 3 and 6 and the work position of FIG. 8. During the rotation of the arms 36 from one position to another the blades 34 slide thanks to rollers 39 set in respective guides 40, that in their turn are hinged in 41 in the basic framework 1, therefore responding to the revolving movement of the arms 36 and to the sliding motion of the blades 34 in the guides 40 with a corresponding rotation from the vertical position of FIGS. 3 and 6 to the horizontal position of FIG. 8. In this way the blades 34 undergo a roto-translatory movement which finally brings them to the horizontal position with consequent closing turnover of the die-cut carton larger flaps 35.

The complete operating cycle of the forming machine illustrated in the drawings is therefore as following.

With the flat die-cut card boards arranged one after the other on the chute 2, the sucker unit 5 is brought to the pick-up position of FIG. 1, where the suckers 5 adhere to the larger side 6 of the nearest die-cut cardboard, taking advantage to this purpose of the depression created inside the suckers by means of conventional devices that are not shown.

The subsequent movement of the sucker unit 5 to the position in FIG. 4 produces the pick-up and the partial opening of said die-cut cardboard, which is then completely opened and squared by the squaring arm 13, as illustrated in FIG. 5.

The cylinders 26 and 33 are subsequently set in action as to produce the shift of levers 16 and 17 to the work position of FIG. 7, where they carry out the folding of the smaller flaps 18 and 19 to the closed position.

The levers 16 and 17 are then recalled to the rest position and right afterwards the cylinders 38 are set in action as to produce the folding of the larger flaps 35 into the closure position of FIG. 8, by means of the side blades 34.

The depression previously applied to the suckers 5 is then removed, therefore the suckers 5 stop adhering to the larger side 6 of the carton. Thanks to a spacing bar 42 operated by pneumatic cylinders 43 held on the supporting frame 4 of the suckers 5, said larger side 6 of the carton (FIGS. 8 and 9) is right afterwards moved away from the set of suckers 5. The carton remains resting on the levers 34.

Figure 9:
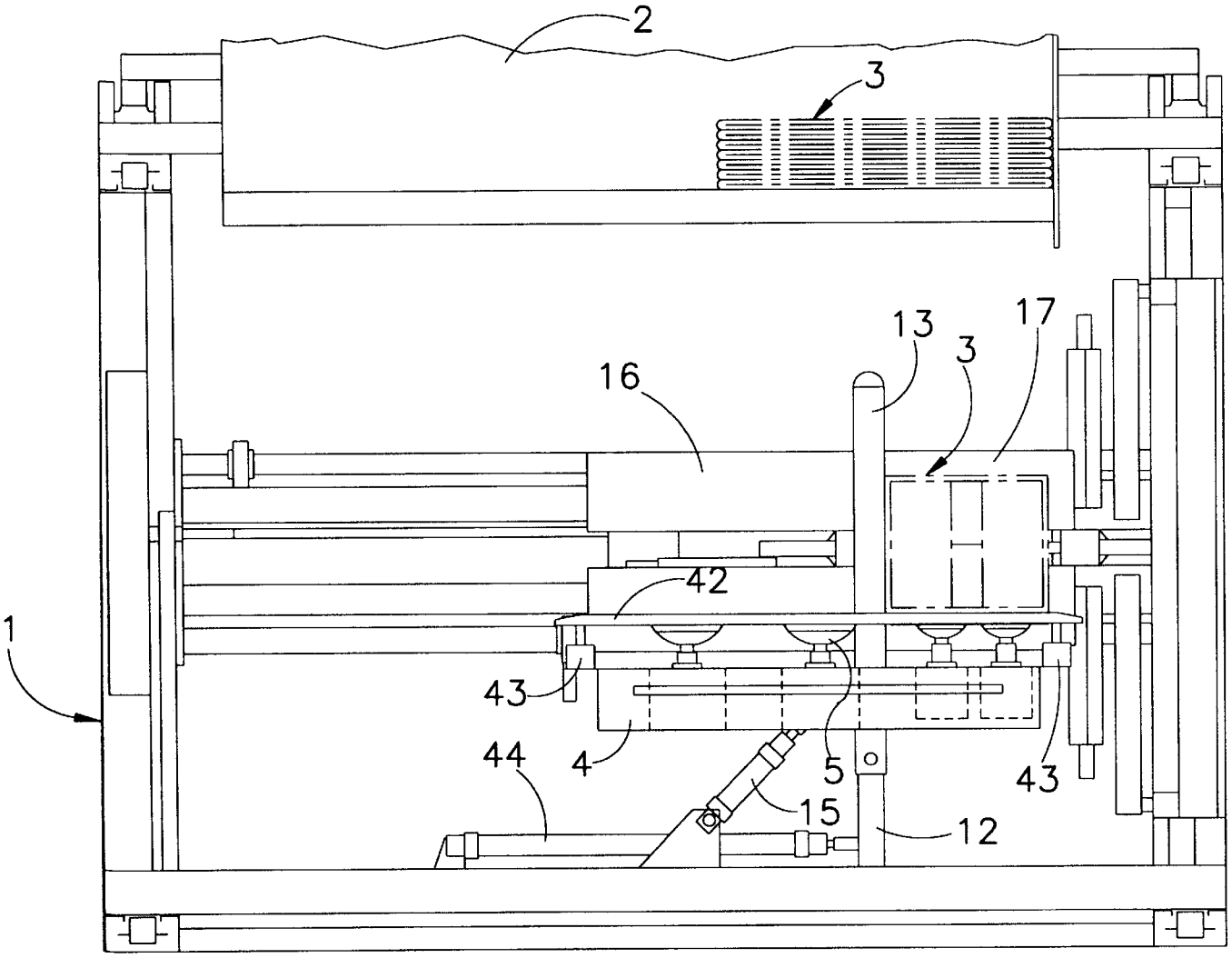
FIG. 9 shows a top plan view of said forming machine during the formed carton expulsion phase.

Finally the cylinder 44 causes the horizontal sliding of the support 12 of the squaring arm 13, which was previously in the straight position of FIG. 5, for the final expulsion of the thus formed box from the inside of the forming machine (FIG. 9).

Obviously various types of devices are provided for adapting the forming machine operation to the different dimensions of cartons to be formed.

I claim:

1. Parallelepiped carton forming machine characterized in that it includes a load and feed chute for a set if die-cut cardboard pieces folded into a flat shape and laid on said chute perpendicular to the chute plane and parallel one after another, a set of depression suckers that move in horizontal direction between a first position near the exit of said chute and suitable for the engagement of the suckers with one of the two coplanar adjacent sides of the nearest die-cut cardboard and a second position suitable for moving the engaged side of the sucker away from the opposite side of the die-cut cardboard and with the simultaneous rotation of the other two sides of the die-cut cardboard for subsequent disposition of the die-cut cardboard in condition of partial opening with open flaps, squaring means for completing the opening and for squaring out the partially open die-cut cardboard, first flap closing means for the closing fold of first bottom flaps connected with said other two sides of the die-cut cardboard and second flap closing means for the closing fold of second bottom flaps connected with the side engaged the suckers and the opposite side of the die-cut cardboard wherein said first flap closing means comprise two first flap closing mechanisms, each mechanism comprising:

a lever;

first and second arms each having a first end pivotable about a respective fixed axis and a second end pivotally connected to said lever, said first ends being spaced from one another and said second ends being spaced apart along said lever; and drive means coupled to one of said arms for rotating said arms about the fixed axes in order to rotate said lever between an inclined rest position and a horizontal work position.

2. Forming machine according to claim 1, characterized in that said squaring means consists of an arm revolving around a vertical journal between an inclined rest position and a work position parallel to said other two sides of the die-cut cardboard.

3. Forming machine according to claim 2, characterized in that said journal of the squaring arm is held by a support which can be moved in horizontal direction in order to carry out the final expulsion of the formed cartons.

4. Forming machine according to claim 1, characterized in that it includes contrasting and guidance means which work in cooperation with said sucker set to hold said opposite side of the die-cut cardboard while said sucker set is moved from the first to the second position, thus favoring the opening of the die-cut cardboard.

5. Parallelepiped carton forming machine characterized in that it includes a load and feed chute for a set of die-cut cardboard pieces folded into a flat shape and laid on said chute perpendicular to the chute plane and parallel one after another, a set of depression suckers that move in horizontal direction between a first position near the exit of said chute and suitable for the engagement of the suckers with one of the two coplanar adjacent sides of the nearest die-cut cardboard and a second position suitable for moving the engaged side of the sucker away from the opposite side of the die-cut cardboard and with the simultaneous rotation of the other two sides of the die-cut cardboard for subsequent disposition of the die-cut cardboard in condition of partial opening with open flaps, squaring means for completing the opening and for squaring out the partially open die-cut cardboard, first flap closing means for the closing fold of first bottom flaps connected with said other two sides of the die-cut cardboard and second flap closing means for the closing fold of second bottom flaps connected with the side engaged the suckers and the opposite side of the die-cut cardboard wherein said second flap closing means comprise two second flap closing mechanisms, each mechanism comprising:

a guide mounted for pivotal movement about a fixed axis;

a pivot arm pivotable about a second axis;

a blade pivotally connected to said pivot arm and mounted for sliding movement along said guide and for pivotal movement relative to one end of said pivot arm; and drive means coupled to said pivot arm for rotating said pivot arm in order to move said blade between a vertical rest position and a horizontal work position by displacing said one end of said pivot arm over a circular path, rotating said blade over a circular path and simultaneously sliding said blade along said guides.

* * * * *